US008443934B2

(12) United States Patent
Akino

(10) Patent No.: US 8,443,934 B2
(45) Date of Patent: May 21, 2013

(54) ACOUSTIC RESISTANCE MEMBER AND METHOD FOR MAKING THE SAME

(75) Inventor: Hiroshi Akino, Tokyo (JP)

(73) Assignee: Kabushiki Kaisha Audio-Technica, Tokyo (JP)

( * ) Notice: Subject to any disclaimer, the term of this patent is extended or adjusted under 35 U.S.C. 154(b) by 0 days.

(21) Appl. No.: 13/312,053

(22) Filed: Dec. 6, 2011

(65) Prior Publication Data

US 2012/0138385 A1 Jun. 7, 2012

(30) Foreign Application Priority Data

Dec. 7, 2010 (JP) ..... 2010-272416

(51) Int. Cl.
*E04B 1/82* (2006.01)
*H04R 11/04* (2006.01)

(52) U.S. Cl.
USPC ..... 181/290; 181/158; 381/359

(58) Field of Classification Search
USPC ..... 181/158, 290; 381/359; 427/596
See application file for complete search history.

(56) References Cited

U.S. PATENT DOCUMENTS

| | | | | |
|---|---|---|---|---|
| 953,557 | A * | 3/1910 | Shepard | 181/196 |
| 3,930,560 | A * | 1/1976 | Carlson et al. | 181/160 |
| 4,525,817 | A * | 6/1985 | Takuya | 367/140 |
| 4,887,693 | A * | 12/1989 | Plice | 181/242 |
| 4,975,966 | A * | 12/1990 | Sapiejewski | 381/189 |
| 4,987,597 | A * | 1/1991 | Haertl | 381/325 |
| 5,828,012 | A * | 10/1998 | Repolle et al. | 181/175 |
| 6,666,295 | B2 * | 12/2003 | Killion et al. | 181/130 |
| 6,704,427 | B2 * | 3/2004 | Kearey | 381/355 |
| 6,932,187 | B2 * | 8/2005 | Banter et al. | 181/149 |
| 7,292,696 | B2 * | 11/2007 | Saeki et al. | 381/175 |
| 2006/0090955 | A1 * | 5/2006 | Cardas | 181/158 |
| 2010/0059309 | A1 * | 3/2010 | Kajihara et al. | 181/169 |

FOREIGN PATENT DOCUMENTS

| | | |
|---|---|---|
| JP | S59-038800 A | 2/1984 |
| JP | 59-38800 | 3/1984 |
| JP | S59-039195 A | 3/1984 |

* cited by examiner

*Primary Examiner* — Jeremy Luks
(74) *Attorney, Agent, or Firm* — Whitham Curtis Christofferson & Cook, PC

(57) ABSTRACT

An acoustic resistance member includes an air-shielding layer which does not allow air to pass through such that acoustic waves do not propagate, and an acoustic resistance layer which allows air to pass through such that acoustic waves propagate. The air-shielding layer is composed of a resin containing a coloring agent, and a part of the air-shielding layer is removed.

11 Claims, 3 Drawing Sheets

ACOUSTIC RESISTANCE MEMBER AND METHOD FOR MAKING THE SAME

TECHNICAL FIELD

The present invention relates to an acoustic resistance member used for adjusting the acoustic resistance of, for example, musical instruments, and audio equipment. In particular the present invention relates to an acoustic resistance member having a desired acoustic resistance value.

BACKGROUND ART

Some electric acoustic converters include an acoustic element composed of an acoustic resistance member. In particular, microphones require acoustic resistance members having appropriate acoustic resistance values in order to obtain flat frequency response and directional characteristics. Examples of usable acoustic resistance members include materials having appropriate breathable characteristics such as clothes, unwoven clothes, and sponges. Unfortunately such acoustic resistance members have uneven aperture sizes; hence, acoustic resistance values of these materials have variations. This precludes the uniformity of acoustic resistance values and ready designing of the acoustic resistance values of the acoustic resistance members. Conventional audio equipment must be produced in consideration of variations in the acoustic resistance values of the acoustic resistance members. Setting the uniform acoustic characteristics of the audio equipment with taking each variation in the acoustic resistance values of the acoustic material into account is a major factor in high cost.

Taking such a situation into account, acoustic resistance members described in Japanese Patent Laid-open Application Publication Nos. S59-38800 and S59-39195 each have a double-layered structure which includes a filler sheet (hereinafter referred to as "filler portion") placed on a part of a mesh portion, which takes on acoustic impedance. The filler portion functions as an air-shielding layer which does not allow acoustic waves to pass through. The mesh portion functions as an acoustic resistance layer which allows acoustic waves to adequately pass through. The air-shielding layer has an opening to expose a part of the acoustic resistance layer. The acoustic resistance layer has even areas between the threads of the mesh. In other words, the acoustic resistance layer has even areas through which acoustic waves pass. Additionally, a part of acoustic resistance layer overlaying the filler portion blocks out acoustic waves. Namely, with the acoustic resistance members described in Japanese Patent Laid-open Application Publication Nos. S59-38800 and S59-39195, the exposed portion of the acoustic resistance layer is formed by making the opening in the air-shielding layer.

In this way, the acoustic resistance members described in Japanese Patent Laid-open Application Publication Nos. S59-38800 and S59-39195 can define an acoustic resistance value from the area of the opening. Thus, the invention described in Japanese Patent Laid-open Application Publication Nos. S59-38800 and S59-39195 can provide the acoustic resistance members having uniform acoustic resistance values.

While the acoustic resistance members described in Japanese Patent Laid-open Application Publication Nos. S59-38800 and S59-39195 can define an area through which acoustic waves pass, the opening portion of the air-shielding layer is made through complicated processes involving, for example, a photographic technique, or piercing. Thus, the acoustic resistance members described in Japanese Patent Laid-open Application Publication Nos. S59-38800 and S59-39195 often have disadvantages of low processing accuracy on making the openings, and thus variations in the areas of the openings. The variations in the areas of the opening in the acoustic resistance members described in Japanese Patent Laid-open Application Publication Nos. S59-38800 and S59-39195 lead to disadvantageously large variations in the acoustic resistance values between individual products. In addition, the acoustic resistance members described in Japanese Patent Laid-open Application Publication Nos. S59-38800 and S59-39195 cannot be readily processed. Thus, the methods for making the acoustic resistance members described in Japanese Patent Laid-open Application Publication Nos. S59-38800 and S59-39195 require many processes and long hours, which disadvantageously causes high cost for making the acoustic resistance members.

SUMMARY OF INVENTION

Technical Problem

The present invention has been accomplished for solving the problems of the technology described above. In other words it is an object of the present invention to provide an acoustic resistance member having an accurate acoustic resistance value, and a method for making the acoustic resistance member through simple production processes at low cost.

Solution to Problem

The acoustic resistance member of the present invention includes an air-shielding layer which blocks air flow such that acoustic waves do not propagate, and an acoustic resistance layer which allows air to pass through such that acoustic waves propagate as an acoustic resistance. The air-shielding layer comprises a resin containing a coloring agent, and a portion of the air-shielding layer is removed to expose the acoustic resistance layer.

The method for making the acoustic resistance member of the present invention includes the air-shielding which does not allow air to pass through such that acoustic waves do not propagate, and the acoustic resistance layer which allows air to pass through such that acoustic waves propagate as an acoustic resistance. The method includes applying a coating material to the acoustic resistance layer, curing the coating material to form the air-shielding layer, and removing a part of the air-shielding layer by irradiation with a laser beam to expose the acoustic resistance layer.

Advantageous Effects of Invention

According to the present invention, the acoustic resistance member has accurate resistance values, and the method for making the acoustic resistance member can produce an acoustic resistance member through simple production processes at low cost.

DESCRIPTION OF THE EMBODIMENTS

An embodiment of an acoustic resistance member of the present invention will be described below with reference to FIGS. 1 to 3.

Figure 1:
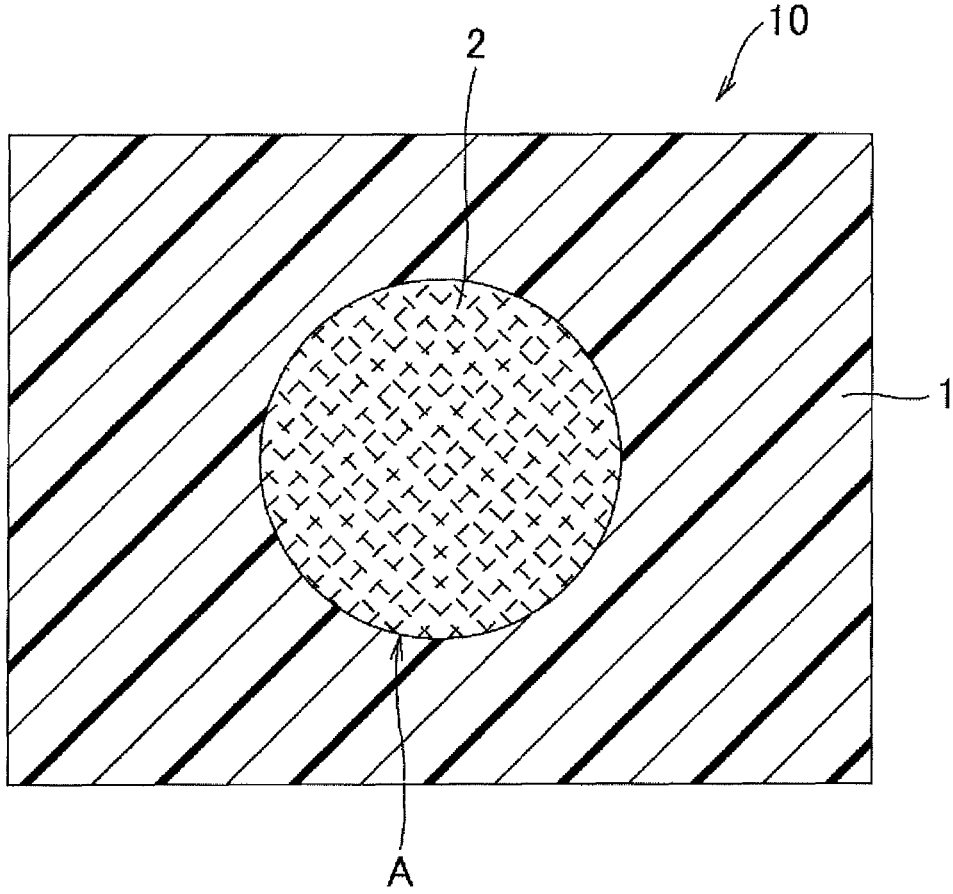
FIG. 1 is a cross-sectional view showing an embodiment of the acoustic resistance member of the present invention.
Figure 2:
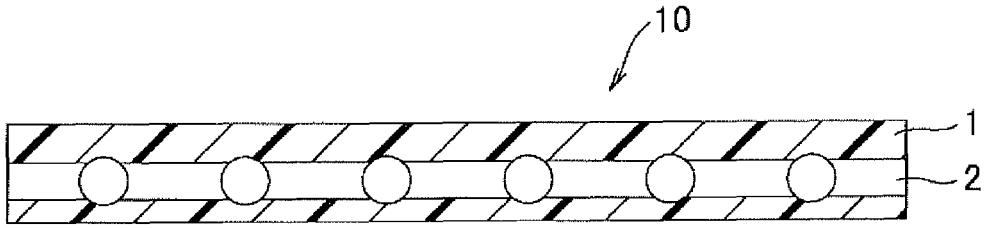
FIG. 2 is a top view of the acoustic resistance member.

In FIG. 1, an acoustic resistance member 10 includes two layers, that is, an air-shielding layer 1 which does not allow air to pass through such that acoustic waves do not propagate, and an acoustic resistance layer 2 which allows air to pass through such that acoustic waves propagate. A circular part of the air-shielding layer 1 is removed to expose the acoustic resistance layer 2. In FIG. 1, the region of the exposed acoustic resistance layer 2 is indicated by reference sign A.

The air-shielding layer 1 is so called cured black coating material containing a resin and a black coloring agent. The air-shielding layer 1 has a thickness which does not allow air to pass through. The cured coating material may contain a solvent and any other appropriate adjuvant. Usable black coloring agents include pigments and dyes. Examples of the pigment include carbon black, iron black, bone black, and lump black. A typical example of the usable dye is nigrosine. Examples of the suitable resin include polyurethane resins and polyamide resins. In particular, polyurethane resins are preferred because they can yield a thick film that effectively blocks the air flow, after the coating material is dried. Examples of the solvent include toluene and ethyl acetate. Alternatively, the coating material may be a toluene free ink in consideration of the environmental issues.

The acoustic resistance layer 2 is composed of a synthetic fiber mesh knitted such a way as to form even open spaces. According to this acoustic resistance layer 2, the variations in areas which allow acoustic waves to pass through between multiple acoustic resistance members can be reduced. Such a synthetic fiber can thus define the acoustic resistance values by the area removed from the air-shielding layer 1 or the size of the region A. The acoustic resistance layer 2 may be composed of a synthetic fiber of an organic polymer, for example, a polyamide fiber. Alternatively, the acoustic resistance layer 2 may be composed of a metal fiber made of stainless steel or plated stainless steel. Preferred materials for the acoustic resistance layer 2 are transparent colorless synthetic fibers which does not absorb the laser beam during the air-shielding layer removing process described below and thus not damage the acoustic resistance layer 2.

The method for making the acoustic resistance member of the present invention will be described below with reference to FIGS. 2 and 3. The acoustic resistance layer 2 is composed of a mesh made of commercially available transparent polyamide fiber.

In the process of applying the coating material, the coating material described above is mixed and applied onto one entire side of the acoustic resistance layer 2. The coating material is then squeezed by a roller or a pallet such that the coating material is applied evenly on the entire acoustic resistance layer 2 into a thickness which does not allow air to pass through. The coating material used here is a polyurethane coating material containing a polyurethane resin and a black dye. The subsequent curing process involves drying the coating material to form an air-shielding layer. In this way, the air-shielding layer 1 and acoustic resistance layer 2 are formed as shown in FIG. 2 according to the method for making the acoustic resistance member of the present invention.

Figure 3:
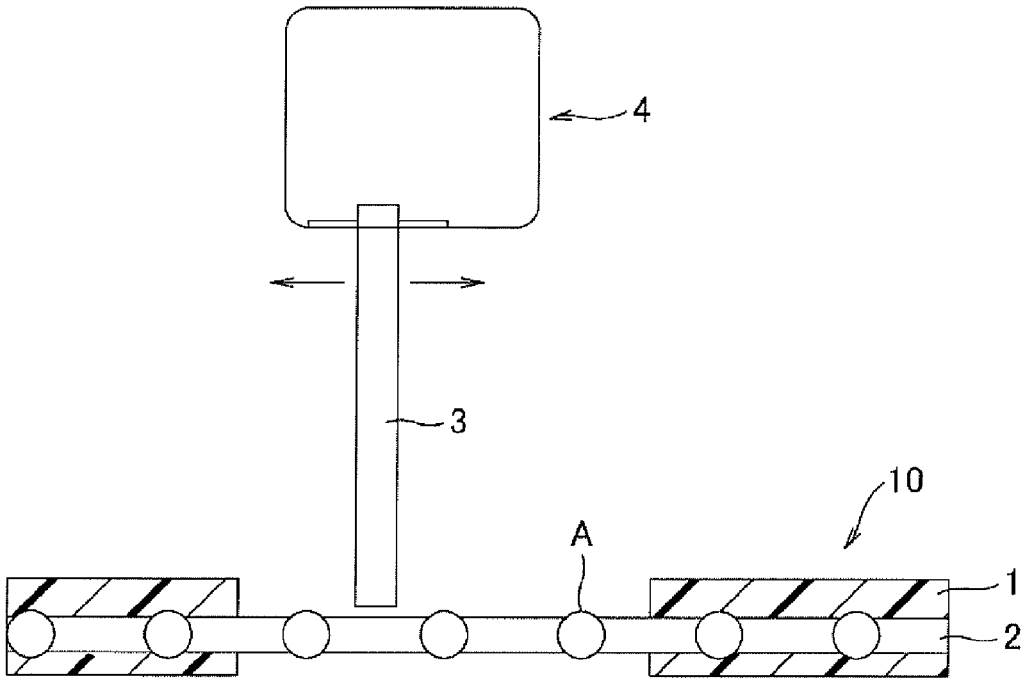
FIG. 3 is an exemplary diagram showing a production process of the acoustic resistance member.

In the air-shielding layer removing process, the surface of the air-shielding layer 1 is irradiated with a laser beam 3 from laser equipment 4 as shown in FIG. 3. The air-shielding layer 1 is heated by the irradiation with the laser beam 3. This irradiated portion of the air-shielding layer 1 is removed due to evaporation or sublimation. After the air-shielding layer removing process, the region A having a desirable exposed area of the acoustic resistance layer 2 can be formed in an acoustic resistance member 10 as shown in FIG. 3. The laser equipment 4 emits the laser beam 3 having enough energy to heat and remove the air-shielding layer 2. The laser equipment 4 includes, for example, an oscillator, a scanning mirror, an fθ lens and other components (they are not shown in the drawings) therein. Then, the laser beam 3 is amplified in the oscillator of the laser equipment 4 and is emitted from the oscillator. Subsequently, the emitted laser beam 3 is converged to a converging point on the surface of the air-shielding layer 1 through the scanning mirror and the fθ lens. The laser equipment 4 can define this converging point by coordinates on the x-axis and the y-axis on the surface of the acoustic resistance member 10 to determine the area to be irradiated. A point or a range to be irradiated with the laser beam 3 is determined on the basis of the information of a plane defined by the x-axis and the y-axis, and the laser equipment 4 can remove the defined area of the air-shielding layer 1 by moving the scanning mirror. The laser equipment 4 includes an yttrium aluminum garnet laser (YAG laser) or a $CO_2$ laser, for example, which has high energy enough to remove the surface of the air-shielding layer 1. The irradiation area is programmed in a computer system of the laser equipment 4, and is specified by the scanning range of the laser beam 3. The laser equipment 4 may be of any type.

In this way, the air-shielding layer 1 is made of a resin containing a black coloring agent which absorbs the energy of the laser beam 3 from the laser equipment 4. In other words, according to the method for making the acoustic resistance member of the present invention, the portion irradiated with the laser beam 3 can be accurately removed with ease. Additionally, according to the method for making the acoustic resistance member of the present invention, the laser equipment 4 can irradiate the air-shielding layer 1 with the laser beam 3 without damaging the acoustic resistance layer 2. Namely, according to the method for making the acoustic resistance member of the present invention, the acoustic resistance member 10 can reduce the variations in the areas of the exposed region A in the acoustic resistance layer 2 to eliminate variations in acoustic resistance values of the acoustic resistance member 10. Thus, according to the method for making the acoustic resistance member of the present invention, the acoustic resistance values can be determined accurately. Additionally, use of a colorless transparent fiber in the acoustic resistance layer 2 allows the laser beam 3 to pass through the acoustic resistance layer 2, which does not absorb the energy of the laser beam 3. This is preferable because the acoustic resistance layer 2 is barely damaged.

In this embodiment, a black coloring agent is used for the air-shielding layer 1, but the present invention is not limited to this. In other words, any other coloring agents can be used for the air-shielding layer 1 as long as the air-shielding layer 1 can be removed by irradiation with a laser beam. Given the absorption of the laser beam 3, a black coloring agent for the air-shielding layer 1 is preferable. In addition, in a device and a method for measuring the acoustic resistance values of the acoustic resistance member 10 in order to adjust acoustic characteristics during the actual production process of microphones, a usable acoustic resistance measuring device is of a type which blows compressed air on the acoustic resistance members of the microphones so as to measure their acoustic resistance values. For example, the device and method for measuring acoustic resistance can produce the acoustic resistance member 10 while measuring and adjusting the acoustic resistance values in accordance with the method for making the acoustic resistance member 10 of the present invention. This configuration allows the laser equipment 4 to be controlled so as to determine an area to be exposed in the acoustic resistance member 10, and automatically expose based on the acoustic resistance value detected by the acoustic resistance value measuring device only by setting the desirable acoustic resistance value to the laser equipment 4.

The shape of the region A of the air-shielding layer 1 is circular in the embodiment shown in the drawings. The region A may have any other shapes. For example, the acoustic resistance member is placed around a long cylindrical sound-pickup tube mounted to the distal end of a microphone unit of a narrow directional microphone. According to the method for making the acoustic resistance member of the present invention, the acoustic resistance member 10 of the present invention can be placed around the sound picking tube described above without, for example, a seal and the acoustic resistance value can be adjusted by irradiating the laser beam 3 as described above.

The acoustic resistance member of the present invention is applicable to acoustic materials used for adjusting acoustic characteristics of, for example, speakers, musical instruments, and acoustic facilities, other than the acoustic resistance members for microphones.

What is claimed is:

1. An acoustic resistance member comprising:

an air-shielding layer which does not allow air to pass through such that acoustic waves do not propagate; and an acoustic resistance layer which allows air to pass through such that acoustic waves propagate;

wherein the air-shielding layer comprises a coating material comprising a coloring agent and a resin; and a part of the air-shielding layer is irradiated with a laser beam to be removed to expose the acoustic resistance layer.

2. The acoustic resistance member according to claim 1, wherein the coloring agent is a black coloring agent.

3. The acoustic resistance member according to claim 1, wherein the resin of the air-shielding layer is polyurethane.

4. The acoustic resistance member according to claim 2, wherein the resin of the air-shielding layer is polyurethane.

5. The acoustic resistance member according to claim 2, wherein the acoustic resistance layer comprises a colorless transparent fiber.

6. The acoustic resistance member according to claim 3, wherein the acoustic resistance layer comprises a colorless transparent fiber.

7. The acoustic resistance member according to claim 4, wherein the acoustic resistance layer comprises a colorless transparent fiber.

8. The acoustic resistance member according to claim 4, wherein the acoustic resistance layer is comprises a mesh comprising a polyamide fiber.

9. The acoustic resistance member according to claim 8, wherein the acoustic resistance layer comprises a colorless transparent fiber.

10. A method for making an acoustic resistance member comprising an air-shielding layer which does not allow air to pass through such that acoustic waves do not propagate and an acoustic resistance layer which allows air to pass through such that acoustic waves propagate, the method comprising the steps of:

applying a coating material on the acoustic resistance layer;

curing the coating material to form the air-shielding layer; and irradiating the air-shielding layer with a laser beam to remove a part of the air-shielding layer to expose the acoustic resistance layer.

11. The method for making the acoustic resistance member according to claim 10, wherein the air-shielding layer comprises a resin comprising a coloring agent.

* * * * *